US012760545B2

(12) United States Patent
Glossop et al.

(10) Patent No.: US 12,760,545 B2
(45) Date of Patent: Oct. 13, 2026

(54) PANEL ASSEMBLY AND INSTALLATIONS INCLUDING A PANEL ASSEMBLY

(71) Applicant: Apex Pool Windows LLC, Phoenix, AZ (US)

(72) Inventors: Dustin Glossop, Phoenix, AZ (US); Neal Moir, Goodyear, AZ (US); Brian Harnisch, Chandler, AZ (US)

(73) Assignee: Apex Pool Windows LLC, Phoenix, AZ (US)

( * ) Notice: Subject to any disclaimer, the term of this patent is extended or adjusted under 35 U.S.C. 154(b) by 105 days.

(21) Appl. No.: 18/442,828

(22) Filed: Feb. 15, 2024

(65) Prior Publication Data

US 2025/0263946 A1 Aug. 21, 2025

(51) Int. Cl.
*E04H 4/14* (2006.01)
*E04F 11/18* (2006.01)
(Continued)

(52) U.S. Cl.
CPC ..... *E04H 4/14* (2013.01); *E04H 4/0075* (2013.01); *E04F 11/1853* (2013.01);
(Continued)

(58) Field of Classification Search
CPC ..... E04H 4/14; E04H 4/0075; E04H 4/148; E04H 4/0043; E04H 4/145; E04H 9/06; E04F 11/1853
See application file for complete search history.

(56) References Cited

U.S. PATENT DOCUMENTS 3,952,338 A * 4/1976 Troxclair ..... E04H 4/144 4/492
9,752,327 B2 * 9/2017 Poradzisz ..... E06B 3/5454
(Continued)

FOREIGN PATENT DOCUMENTS

KR 20240157914 A * 11/2024 ..... E06B 7/30
WO WO-2024196428 A1 * 9/2024 ..... E06B 1/6046

OTHER PUBLICATIONS

Hydrosight Underwater Window, Advantages | Hydrosight, available at: https://www.hydrosight.com/blog/advantages, describing a product believed to be available as early as Feb. 14, 2024, 3 pp.
(Continued)

*Primary Examiner* — Omar F Hijaz
(74) *Attorney, Agent, or Firm* — Fitch, Even, Tabin & Flannery LLP

(57) ABSTRACT

Described herein are panel assemblies for pools or other aquatic installations. A panel assembly may include a transparent panel and a frame including an inner wall having a channel formed therein that receives at least a portion of the transparent panel. The frame may have a first frame jamb, a second frame jamb, and a frame sill. The first frame jamb may have a first base end and a first head end. The second frame jamb may have a second base end and a second head end. The frame sill extends from the first base end to the second base end. The first head end of the first frame jamb may have a first slot. The second head end may have a second slot. The first and second slot may form openings for the channel. The panel assembly further includes at least one sealant layer disposed between the frame and the transparent panel.

17 Claims, 8 Drawing Sheets

(51) Int. Cl.
*E04H 4/00* (2006.01)
*E04H 9/06* (2006.01)

(52) U.S. Cl.
CPC ..... *E04H 4/0043* (2013.01); *E04H 4/145* (2013.01); *E04H 4/148* (2013.01); *E04H 9/06* (2013.01)

(56) References Cited

U.S. PATENT DOCUMENTS

| | | | | |
|---|---|---|---|---|
| 11,891,852 | B1 * | 2/2024 | McSpadden | E06B 3/5864 |
| 12,416,196 | B2 * | 9/2025 | Nill | E06B 3/5454 |
| 2010/0154335 | A1 * | 6/2010 | Feigl | E04F 11/1851 52/579 |
| 2020/0087919 | A1 * | 3/2020 | Ravan | E04F 11/1853 |
| 2021/0115671 | A1 * | 4/2021 | Admiraal | E04F 11/1817 |
| 2023/0084137 | A1 * | 3/2023 | Slagter | F41H 5/013 52/202 |

OTHER PUBLICATIONS

Hydrosight Underwater Window, Videos | Hydrosight, available at: https://www.hydrosight.com/other/help-and-guidance/video, depicting a product believed to be available as early as Feb. 14, 2024, 2 pp.

* cited by examiner

PANEL ASSEMBLY AND INSTALLATIONS INCLUDING A PANEL ASSEMBLY

BACKGROUND OF THE INVENTION

Transparent panels, such as acrylic panels, may be installed in pools and other aquatic installations to provide a view of the pool's interior. The installation of such panels typically involves joining the panel to some concrete structure or shell of the pool. Installation may be performed, for example, by specialists that precisely grind the concrete structure to desired dimensions based on the panel size. Acrylic panels may expand and contract, for example, with ambient temperature changes. In particular, an acrylic panel may expand and contract more than the surrounding concrete structure. As such, installation of acrylic panels may involve achieving precise dimensions, for example, when grinding the concrete structure and positioning the panel within the concrete. The precision involved may result in challenges when installing acrylic panels.

Figure 1:
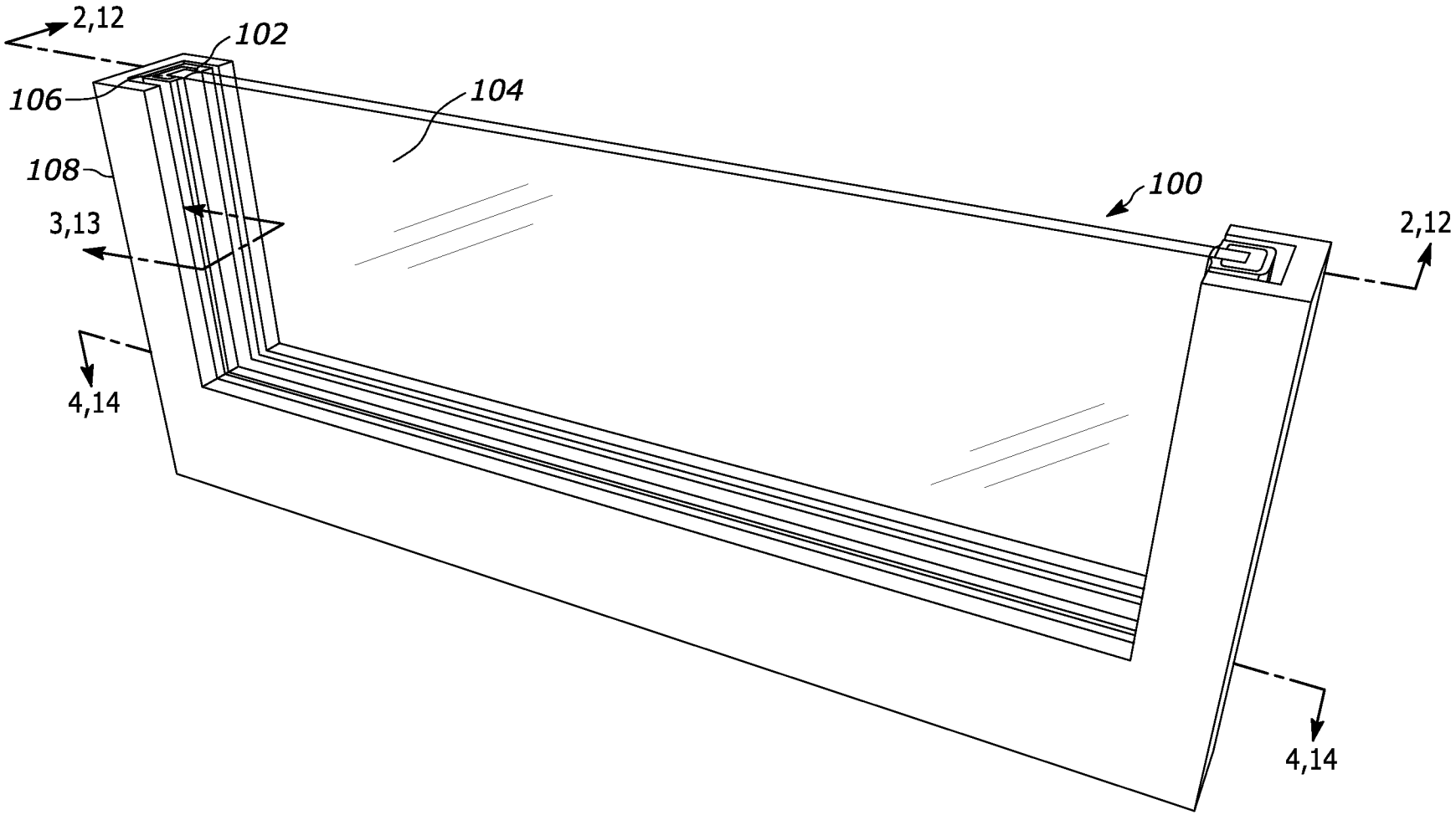
FIG. 1 is a perspective view of a panel assembly disposed in a shell, in accordance with some embodiments.
Figure 2:
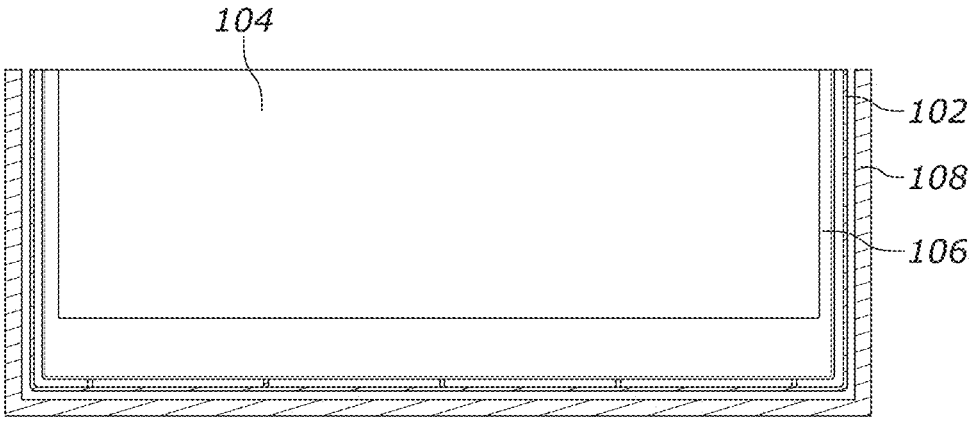
FIG. 2 is a cross-sectional view, taken along line 2-2 in FIG. 1.
Figure 3:
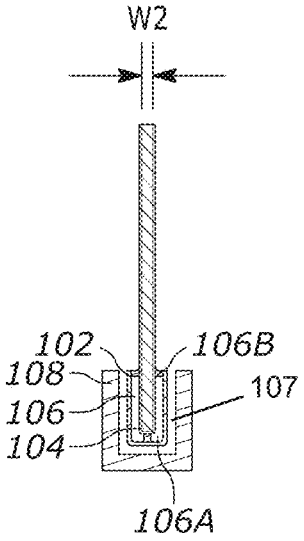
FIG. 3 is a cross-sectional view, taken along line 3-3 in FIG. 1.
Figure 4:
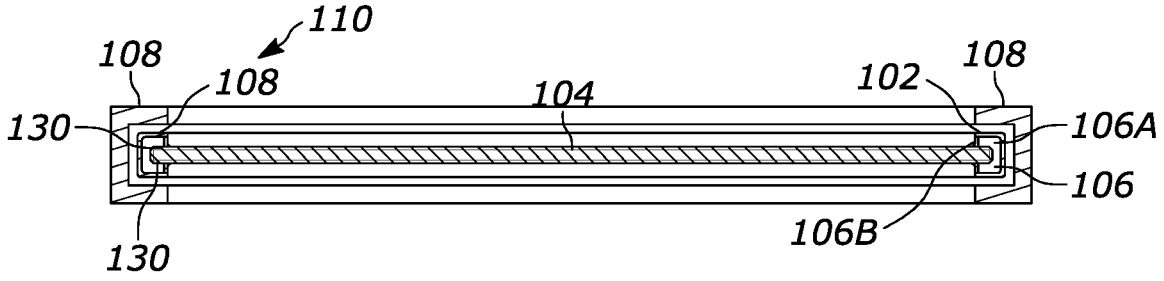
FIG. 4 is a cross-sectional view, taken along line 4-4 in FIG. 1.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present disclosure. Also, common but well-understood elements that are useful or desirable in a commercially feasible embodiment may not be depicted in order to facilitate a less obstructed view of these various embodiments of the present disclosure. Certain actions and/or steps may be described or depicted in a particular order of occurrence while those having ordinary skill in the art will understand that such specificity with respect to sequence is not actually required.

DETAILED DESCRIPTION OF THE INVENTION

Provided herein are panel assemblies and installation methods that may be used, for example, in a pool or other aquatic installation. The panel assemblies described herein may include a transparent panel, a frame having a channel formed therein that receives at least a portion of the transparent panel, and one or more sealants disposed between the frame and the transparent panel. The transparent panels may be made of an acrylic material. In some aspects, the frame is made of a fiberglass material. The sealant layer(s) form a watertight seal between the frame and the transparent panel. The sealant layer(s) may include a grout layer and a silicone layer. The panel assemblies or portions thereof may be installed within a structure or shell.

In typical pool installations, an acrylic panel is installed directly within a concrete structure. Accordingly, typical pool installations do not include the frames described herein. In such installations, the acrylic panel may be inserted directly into a concrete shell along with sealants to provide waterproofing. For example, a crew may grind the concrete wall of a pool or other installation to provide an opening for the acrylic panel. Any errors in the dimensions of the opening may result in a faulty installation. For example, the opening may need to provide room for expansion and contraction of the acrylic panel and, if room is not provided, cracks may develop in the panel. Securing the acrylic panel within a frame as described herein allows a pre-assembled and pre-sealed panel to be installed within concrete as a single assembly.

It is contemplated that the panel assemblies and methods described herein may significantly reduce the installation time for acrylic panels. For example, traditional installations for acrylic panels may take a two-man crew about five days to install. By contrast, the panel assemblies described herein may take about two days to install. In addition, installation by traditional approaches may involve additional drying and cure time for the sealants used to seal the acrylic panel within the concrete. Drying and cure times may last days or weeks, further extending the installation time. For example, sealant cure times may be as long as three weeks. Advantageously, the panel assemblies and methods described herein may save time and, as a result, costs associated with panel installation. For example, the installation cost may be a third to half as expensive using the panel assemblies and methods described herein as compared to traditional installations.

Further, the panel assemblies and methods described herein may also reduce errors that may occur with traditional panel installations. For example, the panel assembly includes appropriate spacings needed to provide for expansion and contraction of the acrylic panels so may reduce the risk of post-installation cracking. Further, because the panel assembly includes a transparent panel pre-installed and sealed within in a frame, the panel assembly takes the guess work out of the installation process and insures appropriate materials are used for installing and sealing the panel in a durable and watertight manner.

The panel assemblies described herein may be used as windows, walls, floors, or other structural components of a pool or other aquatic installation. The panel assemblies described herein may be installed in pools, aquariums, exhibits, or other systems that are fully or partially submerged in water or other liquids. The panel assemblies may include at least one transparent panel to provide, for example, a viewing window for the pool or other aquatic installation. In some examples, the panel assemblies described herein may also be used in a non-aquatic setting, for example, at an exhibit at a zoo.

FIGS. 1-4 illustrate a panel assembly 100 disposed in a shell 108. The shell 108, as depicted in FIG. 1, is a portion of a framework or exterior structure in which the panel assembly 100 is installed. In some examples, the shell 108 is a portion of a pool, aquarium, or aquatic exhibit. In some embodiments, the shell 108 is made of one or more of concrete, gunite, shocrete, or stainless steel. The panel assembly 100 is illustrated in further detail in FIGS. 5-6. The shell 108 is illustrated in further detail in FIGS. 12-14.

The shell 108 includes an opening 110 formed therein. The opening 110 may be sized to provide desired dimensions for a window or viewing panel in a pool, aquarium, or aquatic exhibit. As shown, the opening 110 is generally rectangular in shape, however, the opening 110 may have any desired size or shape based on the application. In some embodiments, the opening 110 may have a length L1 (see FIG. 12) of between about 4 feet and about 20 feet, between about 4 feet and about 15 feet, or between about 4 feet and about 10 feet. In some embodiments, the opening 110, may have height H1 (see FIG. 12) of between about 0.5 foot and about 10 feet, between about 1 foot and about 8 feet, or between about 1.5 feet and about 5 feet. Though the dimension "H1" is described as a height it is to be understood that H1 need not be vertical when the panel assembly 100 is installed.

Figure 12:
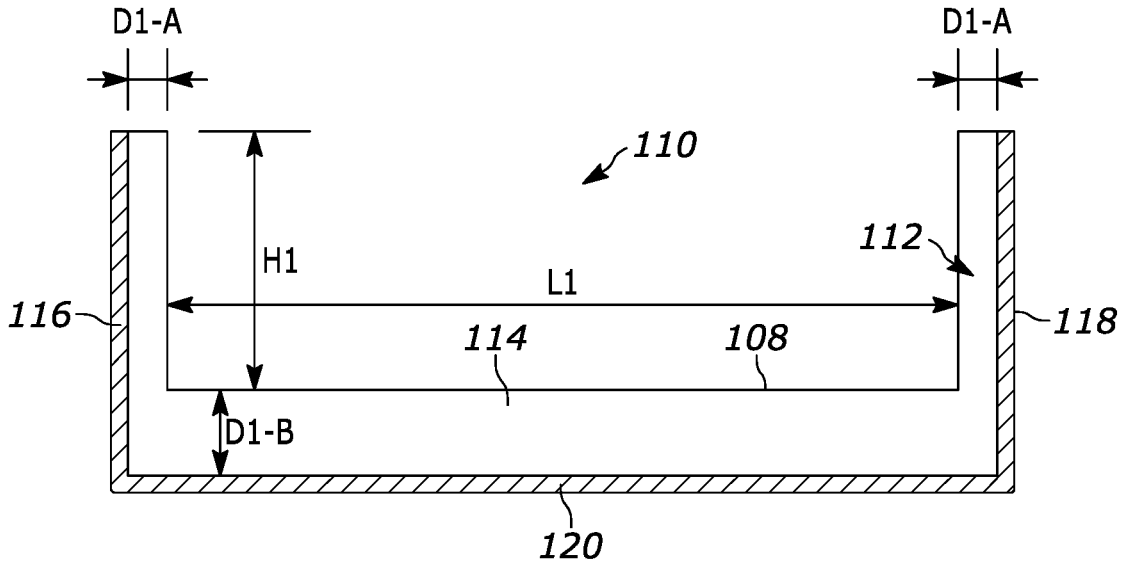
FIG. 12 is a cross-sectional view, taken along line 12-12 of FIG. 1.
Figure 13:
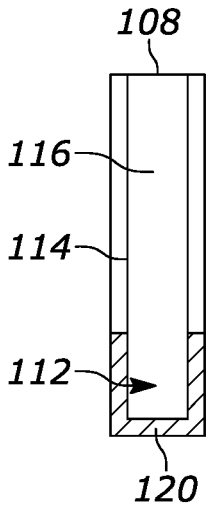
FIG. 13 is a cross-sectional view, taken along line 13-13 of FIG. 1.
Figure 14:
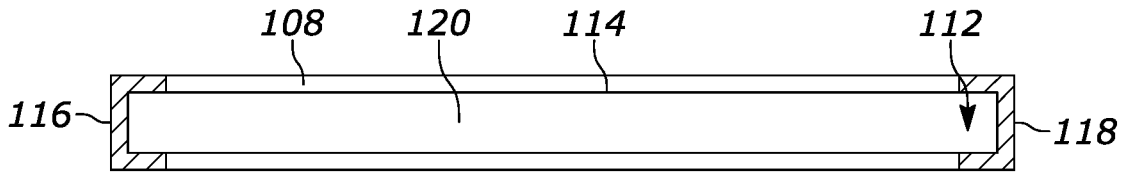
FIG. 14 is a cross-sectional view, taken along line 14-14 of FIG. 1.

As shown in FIGS. 12 and 13, the shell 108 also typically includes an inner shell wall 114 with a groove 112 formed therein. The groove 112 receives at least a portion of the panel assembly 100, namely, a portion of the frame 102 of the panel assembly 100. In some configurations, the groove 112 has a cross-section that is generally C-shaped or generally U-shaped. The shell 108 may have a first shell jamb 116, a second shell jamb 118, and a shell sill 120. The second shell jamb 118 is spaced from and opposite the first shell jamb 116. In some configurations, the first shell jamb 116 is perpendicular to the second shell jamb 118. The shell sill 120 extends between the first shell jamb 116 and the second shell jamb 118. The first shell jamb 116 and the second shell jamb 118 may be side walls of the shell 108 or a portion thereof. The shell sill 120 may be a bottom or base wall of the shell 108 or a portion thereof. The shell sill 120 may act as a support for the panel assembly 100. In some embodiments, the groove 112 extends through each of the first shell jamb 116, the second shell jamb 118, and the shell sill 120.

In some configurations, a depth D1-B of the groove 112 in the shell sill 120 may be greater than a depth D1-A of the groove in the first shell jamb 116 and the second shell jamb 118. In some embodiments, the depth D1-A of the groove 112 in the first shell jamb 116 and the second shell jamb 118 is between about 1 inch and about 10 inches, between about 2 inches and about 8 inches, or between about 2 inches and about 6 inches. In some embodiments the depth D1-B of the groove 112 in the shell sill 120 is between about 5 inches and about 20 inches, between about 5 inches and about 15 inches, or between about 7 inches and about 13 inches. A ratio of the depth D1-A to the depth D1-B may be between about 0.25 and about 0.75, between about 0.30 and about 0.60, and between about 0.35 and about 0.55. Increasing the depth of the groove 112 in the shell sill 120 may help to stabilize the panel assembly 100 in the shell 108. The depth D1-A and the depth D1-B may be dictated, for example, by a thickness W2 of the transparent panel 104.

The panel assembly 100 includes a frame 102, a transparent panel 104 installed within the frame 102, and at least one sealant layer 106 disposed between the frame 102 and the transparent panel 104. In some configurations, the sealant layer(s) 106 includes multiple layers such as, e.g., a grout layer 106A and a silicone layer 106B.

At least one filler material 107 (FIG. 3) may be disposed between the panel assembly 100 and the shell 108. The at least one filler material may include one or more epoxy materials and, in some approaches, may also include a foam material. In some examples, the at least one filler material may include water-based epoxy primer. In some examples, the at least one filler material may include a flexible sculpturing epoxy. Suitable epoxy materials include, for example, Polygem 307 (liquid), Polygem 307 (putty), and AQUA-GEM. Suitable foam materials include, for example, backer rod. The foam material may provide a suitable filler material that can be substituted for a portion of the epoxy to reduce the installation cost.

In some examples, the filler material may be a liquid material that cures as a porous solid. In other examples, the filler material may be a putty or thick gel. In some approaches, a putty filler may be used to fill a space between the shell sill 120 and the panel assembly 100 and a liquid filler may be used to fill a space between the shell jambs 116, 118 and the panel assembly 100. The filler material may secure the panel assembly 100 within the shell 108 and may also provide a waterproof seal therebetween.

In some approaches, the at least filler material may include a material having a Shore A Hardness of between about 55 points and about 85 points, about 60 points and about 80 points, or about 65 points and about 75 points.

In some approaches, the at least filler material may include a material having a tensile strength, as measured via ASTM D-638 standards, of between about 1,800 psi and about 2,400 psi, 1,900 psi and about 2,300 psi, or about 2,000 psi and about 2,200 psi.

The panel assembly 100 may be formed as a single unit that can be inserted into and secured within the shell 108. The panel assembly 100 is shown in further detail in FIGS. 5-6.

Figure 5:
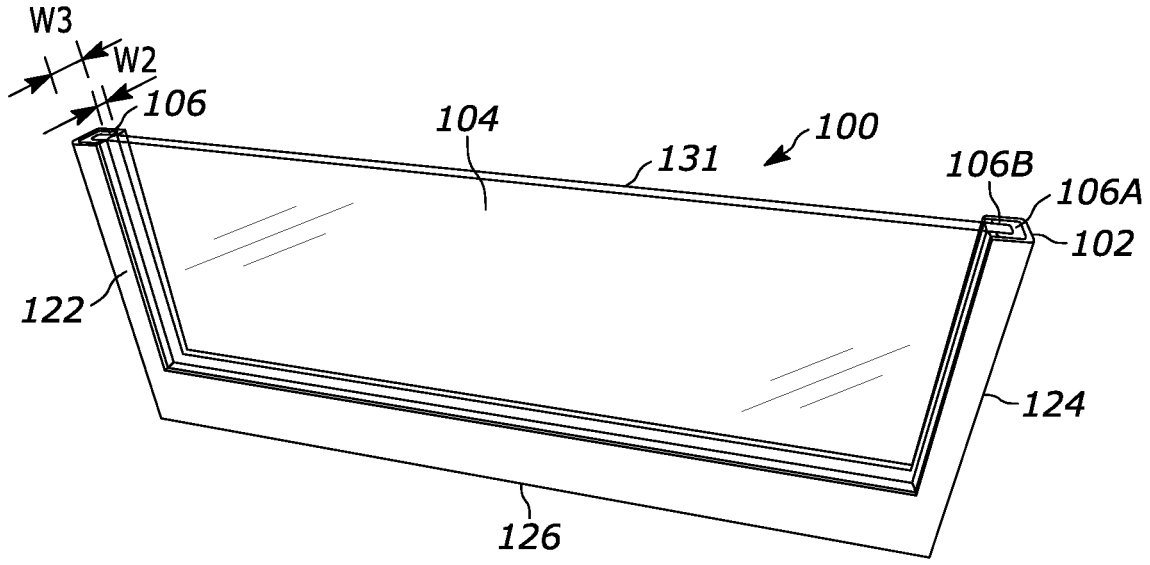
FIG. 5 is a perspective view of panel assembly of FIG. 1.
Figure 6:
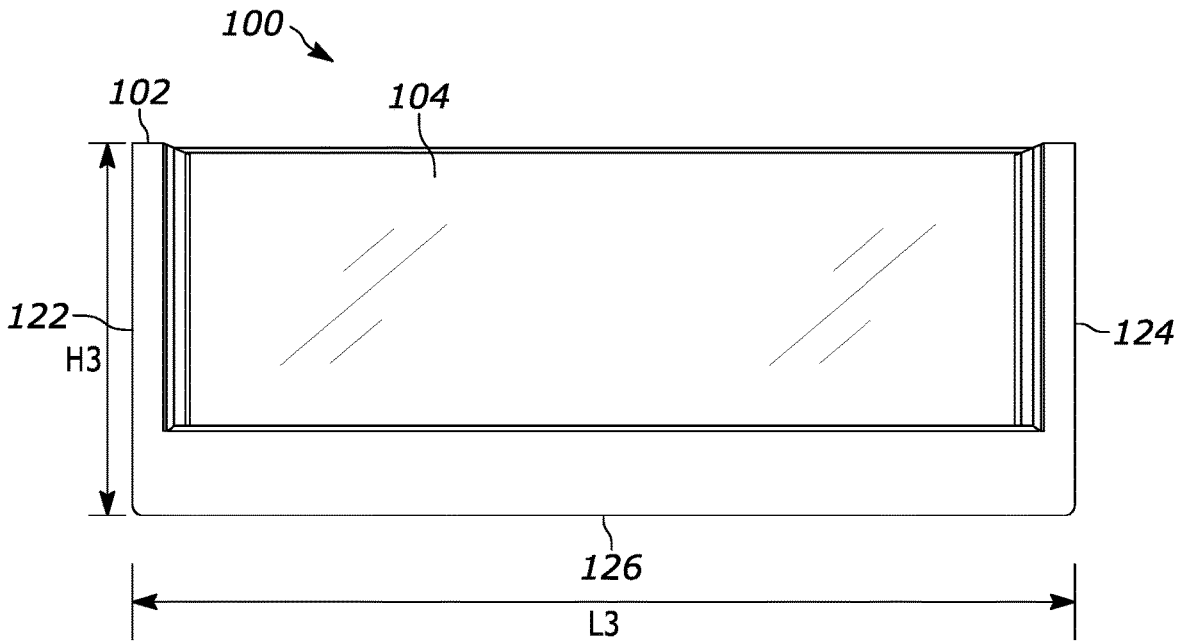
FIG. 6 is a front elevation view of the panel assembly of FIG. 5.

Turning to FIGS. 5-6, the panel assembly 100 includes the transparent panel 104 secured within the frame 102 via the sealant layer(s) 106.

The frame 102 includes an inner frame wall having a channel 128 formed therein. The channel 128 may receive at least a portion of the transparent panel 104 to secure the transparent panel 104 within the frame 102. In some examples, the channel 128 has a cross-section that is generally C-shaped or generally U-shaped It is contemplated that the inner frame wall or portions thereof may also include other features such as curvatures, extensions, protrusions, etc. to assist with securing the transparent panel 104 within the frame 102.

The frame 102 also includes a first frame jamb 122, a second frame jamb 124, and a frame sill 126. The second frame jamb 124 is spaced from and opposite the first frame jamb 122. In some configurations, the first frame jamb 122 is parallel to the second frame jamb 124. The frame sill 126 extends between the first frame jamb 122 and the second frame jamb 124. The first frame jamb 122 and the second frame jamb 124 may be side walls of the frame 102 or portions thereof. The frame sill 126 may be a bottom or base wall of the frame 102 or a portion thereof. The frame sill 126 may act as a main support for the transparent panel 104. In some embodiments, the channel 128 extends through each of the first frame jamb 122, the second frame jamb 124, and the frame sill 126.

Figure 7:
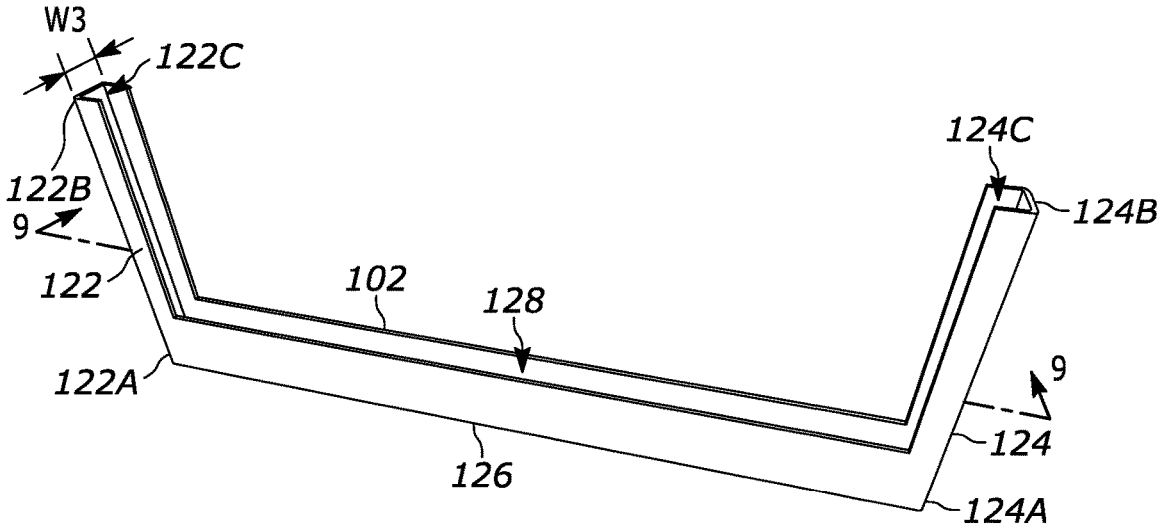
FIG. 7 is a perspective view of a frame of the panel assembly of FIG. 1.
Figure 8:
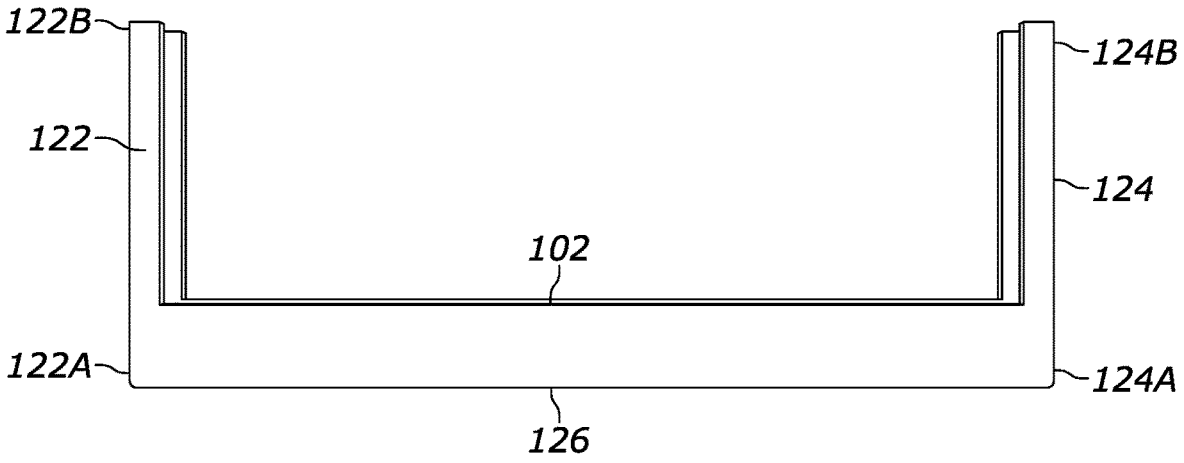
FIG. 8 is a front elevation view of the frame of FIG. 7.
Figure 10:
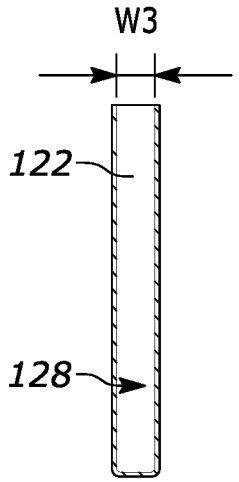
FIG. 10 is a cross-sectional view, taken along line 10-10 of FIG. 7.
Figure 11:
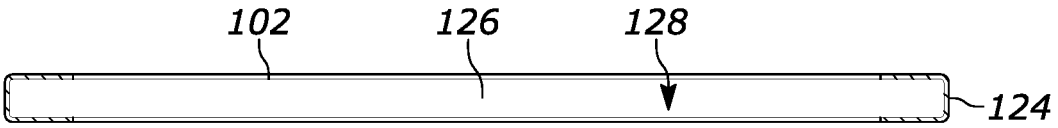
FIG. 11 is a cross-sectional view, taken along line 11-11 of FIG. 7.

In some configurations, the channel 128 may have a width W3 (see FIGS. 5, 7, and 10) of between about 1 inch and about 8 inches, between about 1 inch and about 6 inches, or between about 2 inches and about 2 inches.

Figure 9:
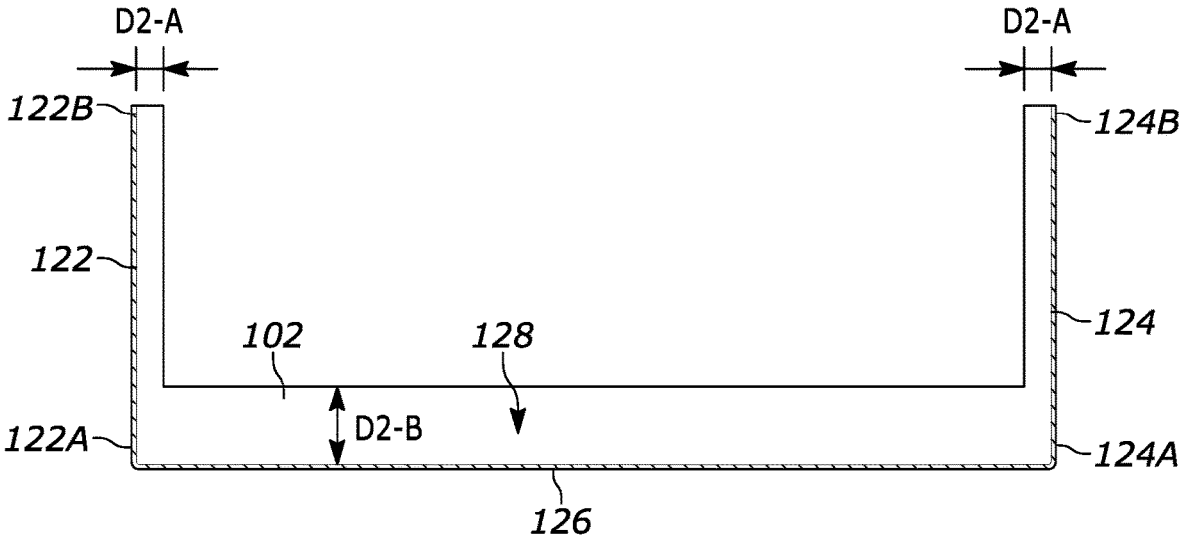
FIG. 9 is a cross-sectional view, taken along line 9-9 of FIG. 7.

In some configurations, the channel 128 may have a depth D2 (see FIG. 9). By some approaches, a depth D2-B of the channel 128 in the frame sill 126 may be greater than a depth D2-A of the channel 128 in the first frame jamb 122 and the second frame jamb 124. A ratio of the depth D2-A to the depth D2-B may be between about 0.10 and about 0.60, between about 0.20 and about 0.50, between about 0.25 and about 0.45, and between about 0.30 and about 0.40. Increasing the depth of the channel 128 in the frame sill 126 may help to stabilize the transparent panel 104 in the frame 102. The depth D2-A and the depth D2-B may be dictated, for example, by the thickness W2 of the transparent panel 104.

In some approaches, the depth D2-A (in inches) of the first frame jamb 122 and the second frame jamb 124 may be dictated by the following formula:

$$D2 - A = W2 + 1$$

For example, if the panel thickness W2 is 2 inches, the depth D2-A of the frame jambs 122, 124 would be 3 inches.

In some approaches, the depth D2-B of the frame sill 126 may be dictated by the following formula:

$$D2 - B = 3(W2) + 1$$

For example, if the panel thickness W2 is 2.5 inches, the depth D2-B of the frame sill 126 would be 8.5 inches.

The first frame jamb 122 may have a first base end or base end portion 122A and a first head end or head end portion 122B. The first base end 122A may be disposed at or adjacent to a junction of the first frame jamb 122 and the frame sill 126. The first head end 122B may include a first slot 122C formed therein. The first slot 122C may serve as an opening for the channel 128 to facilitate inserting and/or removing the transparent panel 104 to/from the frame 102 (e.g., before the transparent panel 104 is sealed within the frame 102). The second frame jamb 124 may have a second base end or base end portion 124A and a second head end or head end portion 124B. The second base end 124A may be disposed at or adjacent to a junction of the second frame jamb 124 and the frame sill 126. The second head end 124B may include a second slot 124C formed therein. The second slot 124C may serve as an opening for the channel 128 to facilitate inserting and/or removing the transparent panel 104 to/from the frame 102 (e.g., before the transparent panel 104 is sealed within the frame 102).

The frame sill 126 may extend or be disposed between the first base end 122A of the first frame jamb 122 and the second base end 124A of the second frame jamb 124. In some approaches, the panel assembly 100 may be installed vertically, for example, as a wall in a pool, aquarium or exhibit. In such an installation, the frame sill 126 may serve as a base or support for the transparent panel 104. In other approaches, the panel assembly 100 may be installed horizontally, for example, as a floor in a pool or exhibit. In such an installation, the first frame jamb 122, the second frame jamb 124, and the frame sill 126 may support the transparent panel 104. Further, when installed horizontally, the frame 102 may include a fourth frame section (not shown) to fully enclose the transparent panel 104.

The frame 102 may be made of a fiber-reinforced plastic material. In some examples, the frame 102 is made of a fiberglass material. In some configurations, the frame 102 may have a thickness of between about 0.1 inch and about 3 inches, between about 0.2 inches and about 2 inches, between about 0.2 inches and about 1.5 inches, between about 0.2 inches and about 1 inch, or between about 0.3 inches and about 0.8 inches.

In some approaches, the frame 102 may be formed via a molding process. In some configurations, the frame is formed as a single unit or has a one-piece design.

The transparent panel 104 typically has a planar body. As used herein, transparent may refer to materials that are primarily clear or see through. One or more portions of the transparent panel 104 may be transparent and, in some embodiments, an entirety of transparent panel 104 is transparent or substantially see through. In some embodiments, the transparent panel 104 is made from an acrylic or leucite material. Though, it is contemplated that other suitable transparent materials may be used. The transparent panel 104 may be tinted with one or more colors and, in some aspects, may also have built-in filtering of ultraviolet (UV) radiation.

The transparent panel 104 may include one or more beveled edges 130. In some configurations, all baring edges of the transparent panel 104 may include a bevel or chamfer. The beveled edges 130 may remove sharpness of the corners and edges. In some approaches, the top edge 131 (see FIG. 5) of the transparent panel 104 may be rounded or angled, for example, at a 45 degree angle. In one example, when the panel assembly 100 is used as a retaining panel to retain or hold water, the top edge 131 is rounded. In another example, when the panel assembly 100 is used as a pour over panel where water spills over the top edge 131, the top edge 131 may be disposed at an angle.

In some embodiments, the transparent panel 104 may have a width W2 (see FIGS. 3 and 5) of between about 0.25 inch and about 5 inches, between about 0.5 inch and about 4 inches, or between about 2 inches and about 4 inches. In some configurations, a ratio of the width W2 of the transparent panel 104 to a width W3 of the channel 128 may be between about 0.30 and about 0.70, between about 0.35 and about 0.65, between about 0.40 and about 0.60, or between about 0.45 and about 0.55.

The sealant layer(s) 106 may be disposed in the channel 128 between the frame 102 and the transparent panel 104. The sealant layer(s) 106 may both secure the transparent panel 104 within the frame 102 and create a seal therebetween. The sealant layer(s) 106 may form a watertight seal between the frame 102 and the transparent panel 104. As discussed above, the sealant layer(s) 106 may include the grout layer 106A and the silicone layer 106B.

The grout layer 106A may include any suitable grout material or combinations thereof. In some examples, the grout layer 106A may include a non-shrink grout. Using a non-shrink grout may allow the grout to set without changing in dimension or introducing movement into the panel assembly 100.

The silicone layer 106B may include any suitable silicone material. One non-limiting example of a suitable silicone material is a silicone sealant such as DOWSIL™ 795. Notably, the silicone layer 106B may be flexible and, in this manner, may allow for the expansion and contraction of the transparent panel 104 within the frame 102. It is contemplated that inclusion of the silicone layer 106B in the panel assembly 100 may help to reduce the risk of the transparent panel 104 cracking due to, for example, exposure to temperature changes once installed.

In some approaches, the silicone layer 106B may have a Shore A Hardness as cured after 21 days 77° Fahrenheit and 50% relative humidity, as measured by ASTM D 2240 standards, of between about 20 points and about 50 points, about 25 points and about 45 points, or about 30 points and about 40 points. A silicone layer 106B with a Shore A Hardness in the aforementioned ranges may provide the desired flexibility to reduce the risk of cracking the transparent panel 104.

In some approaches, the silicone layer 106B may have a tension adhesion strength as cured after 21 days 77° Fahrenheit and 50% relative humidity, as measured by ASTM C 1135 standards, of between about 30 psi and about 60 psi, about 35 psi and about 55 psi, or about 40 psi and about 50 psi, at 25% extension.

Further, in some approaches, the silicone layer 106B may have a joint movement capability as cured after 21 days 77° Fahrenheit and 50% relative humidity, as measured by ASTM C 719 standards, of between about 35% and about 65%, between about 30% and about 60%, or between about 45% and about 55%. A silicone layer 106B with a joint movement capability in the aforementioned ranges may provide the desired flexibility to reduce the risk of cracking the transparent panel 104.

In some embodiments, the panel assembly 100 may have a height H2 of between about 1 foot and about 10 feet, between about 2 foot and about 6 feet, or between about 2 feet and about 4 feet. Though the dimension "H2" is described as a height, it is to be understood that H2 need not be vertical when the panel assembly 100 is installed. In some embodiments, the panel assembly 100 may have a length L3 of between about 4 feet and about 50 feet, between about 4 feet and about 10 feet, between about 10 feet and about 20 feet, between about 5 feet and about 15 feet, between about 20 feet and about 30 feet, between about 30 feet and about 40 feet, or between about 30 feet and about 50 feet. It is contemplated that a panel assembly 100 with the foregoing dimensions may have a weight that is maneuverable for installation while still creating a large viewing window when installed in a pool or other aquatic installation.

In some configurations, the panel assembly is generally rectangular when viewed from the front. In other configurations, the panel assembly 100 may have other shapes such as circular, oblong, cylindrical, square, dome-shaped, etc.

Although FIGS. 1-12 illustrate a panel assembly that is generally rectangular in shape, it is contemplated that the panel assembly may be formed in various shapes and sizes, depending on the application. Although the panel assembly 100 (and components thereof) and the shell 108 are depicted with straight edges in FIGS. 1-12, it is to be understood that these edges could also be formed in any suitable shape and, in some examples, may be curved or rounded to achieve various shapes.

The panel assembly 100 shown and described with reference to FIGS. 1-14 may be installed as part of a kit. The kit may be, for example, an installation kit that includes one or more components such as materials and/or tools that may be used to install the panel assembly 100 within a shell such as the shell 108. In some examples, the kit may include at least one panel assembly 100, at least one airbag, and the at least one sealant for the at least one sealant layer 106. The use of the airbag is described further with reference to the installation method of FIG. 15.

Figure 15:
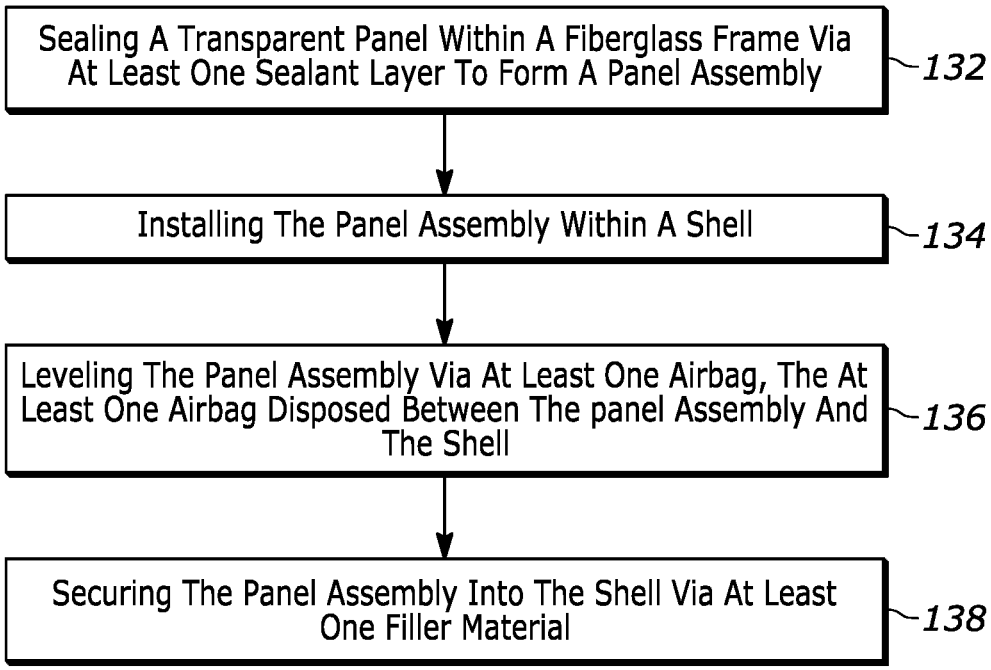
FIG. 15 is a method of installing a panel assembly, in accordance with some embodiments.

Turning now to FIG. 15, a method of installing a transparent panel in a pool or other aquatic installation is shown. In some embodiments, the method may be used to install the transparent panel 104 in the shell 108. Further, the method may be used to assemble and install the panel assembly 100 shown and described with reference to FIGS. 1-14.

At block 132, the method includes sealing a transparent panel within a fiber-reinforced plastic frame via at least one sealant layer to form a panel assembly. In some examples, the fiber-reinforced plastic frame may be a fiberglass frame. In some approaches, the transparent panel may be the transparent panel 104, the at least one sealant layer may be the at least one sealant layer 106, and the panel assembly may be the panel assembly 100 described above.

At block 134, the method includes installing the panel assembly within a shell. In some examples, the shell is a concrete shell, though the shell may also be gunite, shocrete, or stainless steel. In some approaches, the panel assembly may be the panel assembly 100 and the shell may be the shell 108 described above. The method may further include curing and/or drying the at least one sealant layer prior to installing the panel assembly within the shell. Curing and/or drying may be accomplished, for example, by waiting a predetermined amount of time. The predetermined amount of time may determine on the type of sealants used.

At block 136, the method includes leveling the panel assembly via at least one airbag. The at least one airbag may be disposed between the panel assembly and the shell. In some approaches, the panel assembly may be the panel assembly 100 described above. Any suitable airbag may be used to level the panel assembly in the shell. In some examples, the airbag is sized to fit within a groove in the channel. In some approaches, one airbag may be positioned at or adjacent to base corners (e.g., at the first base end 122A and the second base end 124A) of the panel assembly and one or more airbags may be positioned between the base corners (e.g., between the first base end 122A and the second base end 124A).

The airbags may be inflated and/or deflated to level the panel assembly within the concrete channel. The use of airbags may reduce or eliminate the need to use shims for installation and may also reduce the need for removing and/or reinserting the panel assembly within the shell to reposition and add/remove shims during the installation process.

To accomplish the leveling at block 136, the method may also include positioning the at least one airbag within the fiberglass frame. In particular, the at least one airbag may be positioned within a channel of the fiberglass frame.

At block 138, the method includes securing the panel assembly into the shell via at least one filler material. In some approaches, the panel assembly and the at least one filler material may be the panel assembly 100 described above. The at least one airbag may be sealed within the shell, along with the panel assembly, and encased by the filler material. In some examples, the at least one airbag may be made of a strong flexible textile material such as a vinyl, ballistic nylon, rubber, or fiber-reinforced material. In some approaches, the airbag may be filled with the filler material once the airbag is sealed within the shell with the panel assembly. In some approaches, the airbags may be capped before they are encased by the filler material.

In some approaches, the panel assembly may be sealed in the shell via a first filler and a second filler. The first filler may be, for example, an AQUA-GEM epoxy. The second filler may be, for example, a PolyGem epoxy. The shell may first be coated with the AQUA-GEM epoxy, for example, before the panel assembly is installed in the shell. The space between the shell and the panel assembly may then be filled with the PolyGem epoxy. In some approaches, a PolyGem putty may be used to fill the sill of the shell and a PolyGem liquid may be used to fill the jambs of the shell.

The terms and expressions used herein have the ordinary technical meaning as is accorded to such terms and expressions by persons skilled in the technical field as set forth above except where different specific meanings have otherwise been set forth herein. The word "or" when used herein shall be interpreted as having a disjunctive construction rather than a conjunctive construction unless otherwise specifically indicated. The terms "coupled," "fixed," "attached to," and the like refer to both direct coupling, fixing, or attaching, as well as indirect coupling, fixing, or attaching through one or more intermediate components or features, unless otherwise specified herein.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B. Similarly, the word "or" when used herein shall be interpreted as having a disjunctive construction rather than a conjunctive construction unless otherwise specifically indicated.

While there have been illustrated and described particular embodiments of the present invention, it will be appreciated that numerous changes and modifications will occur to those skilled in the art, and it is intended for the present invention to cover all those changes and modifications which fall within the scope of the appended claims.

The invention claimed is:

1. An aquatic installation comprising:

a concrete shell;

a prefabricated panel assembly disposed in the concrete shell, the prefabricated panel assembly including:

a transparent panel;

a fiberglass frame including an inner wall having a channel formed therein that receives at least a portion of the transparent panel, the fiberglass frame having a first frame jamb, a second frame jamb opposite the first frame jamb, and a frame sill, the first frame jamb having a first base end and a first head end, the second frame jamb having a second base end and a second head end, the frame sill extending from the first base end to the second base end, the first head end having a first slot and the second head end having a second slot, the first slot and second slot forming openings for the channel; and at least one sealant layer disposed between the fiberglass frame and the transparent panel, the at least one sealant layer forming a watertight seal between the fiberglass frame and the transparent panel; and a filler material disposed between the concrete shell and the prefabricated panel assembly to seal the prefabricated panel assembly within the concrete shell, the filler material comprising one or more epoxy materials.

2. The aquatic installation of claim 1, wherein a depth of the frame sill is greater than a depth of the first frame jamb and the second frame jamb.

3. The aquatic installation of claim 1, wherein the transparent panel is made of an acrylic material.

4. The aquatic installation of claim 1, wherein the at least one sealant layer includes a grout layer and a silicone layer; and wherein the grout layer includes a non-shrink grout material.

5. The aquatic installation of claim 1, further comprising at least one airbag disposed between the prefabricated panel assembly and the concrete shell.

6. The aquatic installation of claim 4, wherein the silicone layer is a moisture-tolerant adhesive.

7. The aquatic installation of claim 1, wherein the transparent panel has a thickness of between about 0.5 inch and about 4 inches and a length of between about 5 feet and about 40 feet.

8. The aquatic installation of claim 1, wherein the channel in the fiberglass frame has a cross-section that is generally C-shaped.

9. The aquatic installation of claim 1, wherein the prefabricated panel assembly is disposed in a shell, the shell having a groove formed therein that receives at least a portion of the fiberglass frame.

10. The aquatic installation of claim 1, wherein the transparent panel includes at least one edge that is not fully enclosed by the fiberglass frame.

11. The aquatic installation of claim 1, wherein the at least one sealant layer includes a flexible material capable of expansion and contraction, the at least one sealant layer forming a watertight seal between the fiberglass frame and the transparent panel.

12. The aquatic installation of claim 1, wherein the filler material further includes a foam material.

13. A method comprising:

sealing a transparent panel within a channel disposed in an inner wall of a fiberglass frame via at least one sealant layer to form a prefabricated panel assembly, the fiberglass frame having a first frame jamb, a second frame jamb opposite the first frame jamb, and a frame sill, the first frame jamb has a first base end and a first head end, the second frame jamb having a second base end and a second head end, the frame sill extending from the first base end to the second base end, the first head end having a first slot and the second head end has a second slot, the first slot and second slot forming openings for the channel, and the at least one sealant layer disposed between the fiberglass frame and the transparent panel, the at least one sealant layer forming a watertight seal between the fiberglass frame and the transparent panel;

installing the prefabricated panel assembly within a concrete shell via a filler material, the filler material disposed between the concrete shell and the prefabricated panel assembly to seal the prefabricated panel assembly within the concrete shell, the filler material comprising one or more epoxy materials;

leveling the prefabricated panel assembly in the concrete shell via at least one airbag, the at least one airbag disposed between the prefabricated panel assembly and the concrete shell; and securing the prefabricated panel assembly into the concrete shell via at least one filler material.

14. The method of claim 13, wherein securing the transparent panel includes securing at least two sides of the transparent panel within the fiberglass frame.

15. The method of claim 13, wherein the at least one sealant layer includes a grout layer and a silicone layer.

16. The method of claim 13, further comprising: positioning the at least one airbag within the channel of the fiberglass frame.

17. An aquatic installation comprising:

a concrete shell;

a prefabricated panel assembly disposed in the concrete shell, the prefabricated panel assembly including:

a transparent panel;

a fiberglass frame including an inner wall having a channel formed therein that receives at least a portion of the transparent panel, the fiberglass frame having a first frame jamb, a second frame jamb opposite the first frame jamb, and a frame sill, the first frame jamb having a first base end and a first head end, the second frame jamb having a second base end and a second head end, the frame sill extending from the first base end to the second base end, the first head end having a first slot and the second head end having a second slot, the first slot and second slot forming openings for the channel; and at least one sealant layer disposed between the fiberglass frame and the transparent panel, the at least one sealant layer forming a watertight seal between the fiberglass frame and the transparent panel;

a filler material disposed between the concrete shell and the prefabricated panel assembly to seal the prefabricated panel assembly within the concrete shell; and at least one airbag disposed in the filler material between the concrete shell and the prefabricated panel assembly.

* * * * *